United States Patent [19]

Uchida et al.

[11] Patent Number: 4,461,466

[45] Date of Patent: Jul. 24, 1984

[54] PAPER FEEDING DEVICE FOR RECORDING APPARATUS

[75] Inventors: Tohru Uchida; Shigehiro Suzuki; Tatsuo Yajima; Yutaka Seto, all of Hachioji, Japan

[73] Assignee: Konishiroku Photo Industry Co., Ltd., Tokyo, Japan

[21] Appl. No.: 350,427

[22] Filed: Feb. 22, 1982

[30] Foreign Application Priority Data

Mar. 12, 1981 [JP] Japan ..... 56-34510

[51] Int. Cl.[3] ..... B65H 3/32

[52] U.S. Cl. ..... 271/22; 271/117; 271/124; 271/126

[58] Field of Search ..... 271/22, 117, 121, 124, 271/126, 153, 154, 155

[56] References Cited

U.S. PATENT DOCUMENTS

| | | | |
|---|---|---|---|
| 3,981,497 | 9/1976 | Feinstein | 271/117 X |
| 4,113,244 | 9/1978 | Ruenzi | 271/121 X |
| 4,113,245 | 9/1978 | Colglazier | 271/121 X |
| 4,171,129 | 10/1979 | Daley | 271/126 X |
| 4,319,741 | 3/1982 | Okamoto | 271/121 X |
| 4,368,880 | 1/1983 | Shimizu | 271/121 |

*Primary Examiner*—Richard A. Schacher

*Attorney, Agent, or Firm*—Linda Bierman; Jordan B. Bierman; C. Cornell Remsen, Jr.

[57] ABSTRACT

A paper feeding device used for feeding stacked paper to an electrophotographic copying machine is provided with a lift for a stack of papers, which move the top sheet against a swingably supported feeding roller as the size of the stack decreases under use. Forwardly of the feeding roller in the direction of travel of the paper is a plate in frictional contact with the roller, the paper being thus fed forwardly to the copying machine through the nip between the roller and plate. This arrangement avoids the problem of a multifeed of the sheets. The feeding-out operation may be further improved by the provision of separating claws engaging the leading corners of the paper as it passes from the feeding roller. Raising of the lift is controlled by a detecting device actuated by position of the swingable support for the feeding roller.

4 Claims, 4 Drawing Figures

PAPER FEEDING DEVICE FOR RECORDING APPARATUS

BACKGROUND OF THE INVENTION

1. Field of the Invention

The present invention relates to a paper feeding device for a recording apparatus, and more particularly a paper feeding device wherein several thousand sheets of paper can be loaded simultaneously.

2. Description of the Prior Art

A paper feeding device with the structure shown in Japanese Patent Publication No. 21696/1980, for example, has been known in the past as a paper feeding device used in an electrophotographic copying machine among others. Specifically, this paper feeding device comprises a paper feeding roller that is made of frictional material, and is supported horizontally, a fanning out rubber plate made of frictional material that is ordinarily in pressure contact with the circumferential surface of said paper feeding roller and prevents the multiple feeding of plural papers, and a paper feeding tray on the top surface of which a large number of papers can be loaded; one end of the device is rotatably supported at a fixed position, and the force of a spring is applied so that the free end thereof is in pressure contact with the circumferential surface of said paper feeding roller. In the paper feeding device with such a structure, therefore, the top sheet of paper of the papers loaded on the paper feeding tray is in pressure contact with the circumferential surface of the paper feeding roller, under pressure from the force of the spring, and the sheets are fed out one by one by the driving force of the paper feeding roller and the deterrent force of the fanning out rubber plate. With such a structure, however, if a large number of papers are loaded on the paper feeding tray simultaneously, the force of pressure contact caused by the spring varies extremely and therefore, the quantity of papers to be loaded on said paper feeding tray is limited to 200 to 300 sheets at the best.

Incidentally, a simultaneous copying process for a large number of sheets has been requested for a recent electrophotographic copying machine. In such a case, a frequent supplying of the copying paper on the paper feeding tray is needed for the paper feeding device as explained above, which imposes a troublesome work on a copying operator.

SUMMARY OF THE INVENTION

In consideration of the real situation in the past as described above, the present invention proposes a paper feeding device for a copying machine and the like comprising a swiveling member supported at a fixed position of the device, which is movable upwardly and downwardly, a cylindrical paper feeding roller that is rotatably supported horizontally on said swiveling member, a peeling-off member that is in constant pressure contact with the circumferential surface of said paper feeding roller and can follow the vertical motion of aforesaid paper feeding roller, a lift that is located under aforesaid paper feeding roller and carries a large number of stacked papers and is movable upward and a position detector that is actuated by the position of aforesaid swiveling member and raises the lift according to the position of the swiveling member.

DETAILED DESCRIPTION OF THE PREFERRED EMBODIMENT

Figure 1:
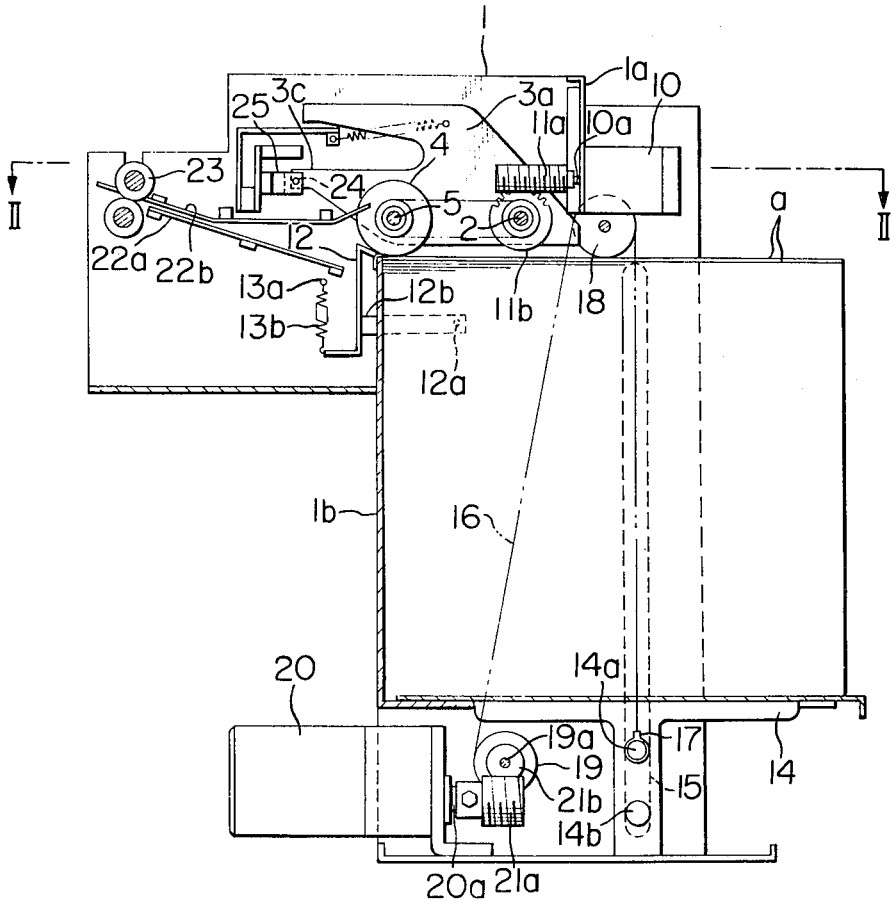
FIG. 1 is a side view of a paper feeding device of the present invention.
Figure 4:
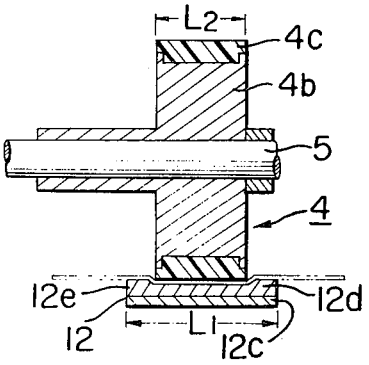
FIG. 4 is a cross-sectional view taken on line IV—IV in FIG. 3.

FIG. 1 is a side view of a paper feeding device of the present invention in which a horizontal shaft 2 is rotatably supported at the upper part of a frame 1 of said device and a reciprocable subframe having end plates 3*a* and 3*b* swingably mounted on said horizontal shaft 2. Between the lower edges of end plates 3*a* and 3*b* is mounted a supporting shaft 5 that supports a paper feeding roller 4. This paper feeding roller 4, as shown in FIG. 4, consists of the supporting shaft 5, a hollow cylindrical shaft 4*a* rotatably mounted on the middle portion of said supporting shaft 5, a disk-like body 4*b* that is formed solidly on the external circumferential surface at one end of said cylindrical shaft 4*a*, and a cylindrical layer 4*c* made of a frictional material on the external circumferential surface of this body 4*b*. On the external circumferential surface at the other end of said cylindrical shaft 4*a*, a gear 6 that is larger in diameter than the cylindrical shaft 4*a* is solidly attached. Further, on the external circumferential surface at one end of a cylindrical shaft 7 rotatably mounted on said horizontal shaft 2, a gear 8 that is nearly the same as said gear 6 in diameter is solidly fixed, and between this gear 8 and aforesaid gear 6, a timing belt 9 is connected. To the rear wall 1*a* at the upper part of the frame 1 is mounted a driving motor 10 having a device shaft 10*a* connected to the cylindrical shaft 7 by a pair of worm gears 11*a* and 11*b*. Against the circumferential surface of the aforesaid paper feeding roller 4, a detachable plate 12 made of a frictional material makes a line pressure contact. The detachable plate 12 is adhesively attached to a seating surface 12*c* of a reciprocating arm 12*b* whose far end portion extends between frames located beneath the horizontal shaft 2 with a fulcrum on the supporting shaft 12*a*; the other end portion of said reciprocating arm 12*b* is attached to one end of the coil spring 13*b* whose other end is fixed with a screw 13*a* or other suitable means to the frame 1 of the device. The width L1 of the detachable plate 12 is, as shown in FIG. 4, greater than the width L2 of the paper feeding roller 4 and on its contacting surface 12*d*, a block 12*e* is solidly coated.

Beneath the paper feeding roller 4, on the other hand, the lift platform 14 on which a large number of papers a are stacked is provided. On both sides at the base of this platform 14, a pair of guide bars 14*a* and 14*b* for the vertical movement of the lift are provided and these guide bars 14*a* and 14*b* slidably engage a guide groove 15 in the frame for the vertical movement. One end of each wire 16 is fixed to opposite ends of the guide bar 14*a* through a sleeve 17, and the other ends of said wires 16 are wound around a driving pulley 19 provided at the lower portion of the frame 1 through a pulley 18 provided on the upper portion of the frame at the guide grooves 15. A driving shaft 20*a* of the driving motor 20 attached to the bottom portion of the frame 1 of the device is connected through the worm gear 21*a* and the gear 21*b* to the supporting shaft 19*a* of the driving pulley 19, and aforesaid lift platform 14 is raised by the regular rotation of the driving motor 20 and lowered by the reverse rotation.

Furthermore, in the frame 1 of the device located at the front of the paper feeding roller 4, a pair of guide plates 22*a* and 22*b* forming a guide path for the paper a that has passed through the gap between the paper feeding roller 4 and the detachable plate 12 are provided, and a registration roller 23 is provided at the tip of these guide plates 22*a* and 22*b*. A position detector 24 is attached by member 25 inside of frame 1 of the device, and is located near said guide plates 22*a* and 22*b*. This position detector 24 is actuated by a flapper 3*c* protruding from the tip of said reciprocating member 3*a*. The position detector 24 is composed of a photodetector (not shown) and a light-emitting element 24*a* is provided, facing and being apart from said photodetector 24; the driving motor 20 for the lift 14 is stopped when the flapper 3*c* breaks through the beam that radiates from the light-emitting element 24*a* toward the photodetector 24. The position detector 24 may be substituted by a microswitch instead of the photodetector, used only as an example.

Figure 2:
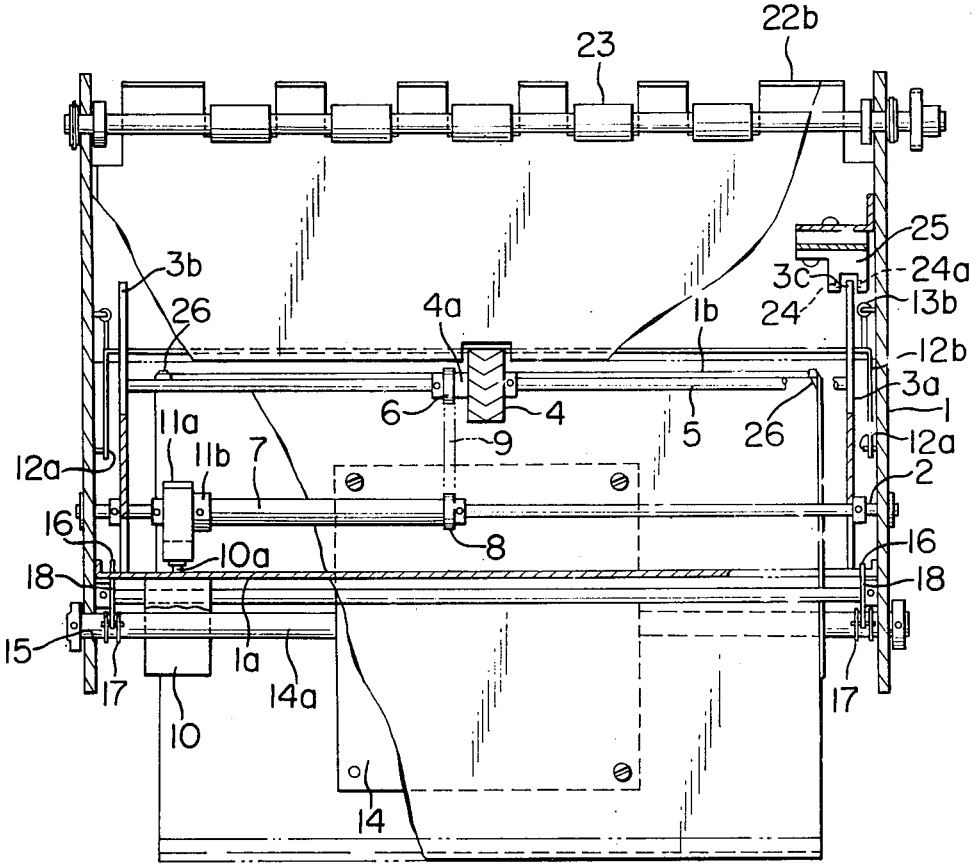
FIG. 2 is a cross-sectional view taken on line II—II in FIG. 1.
Figure 3:
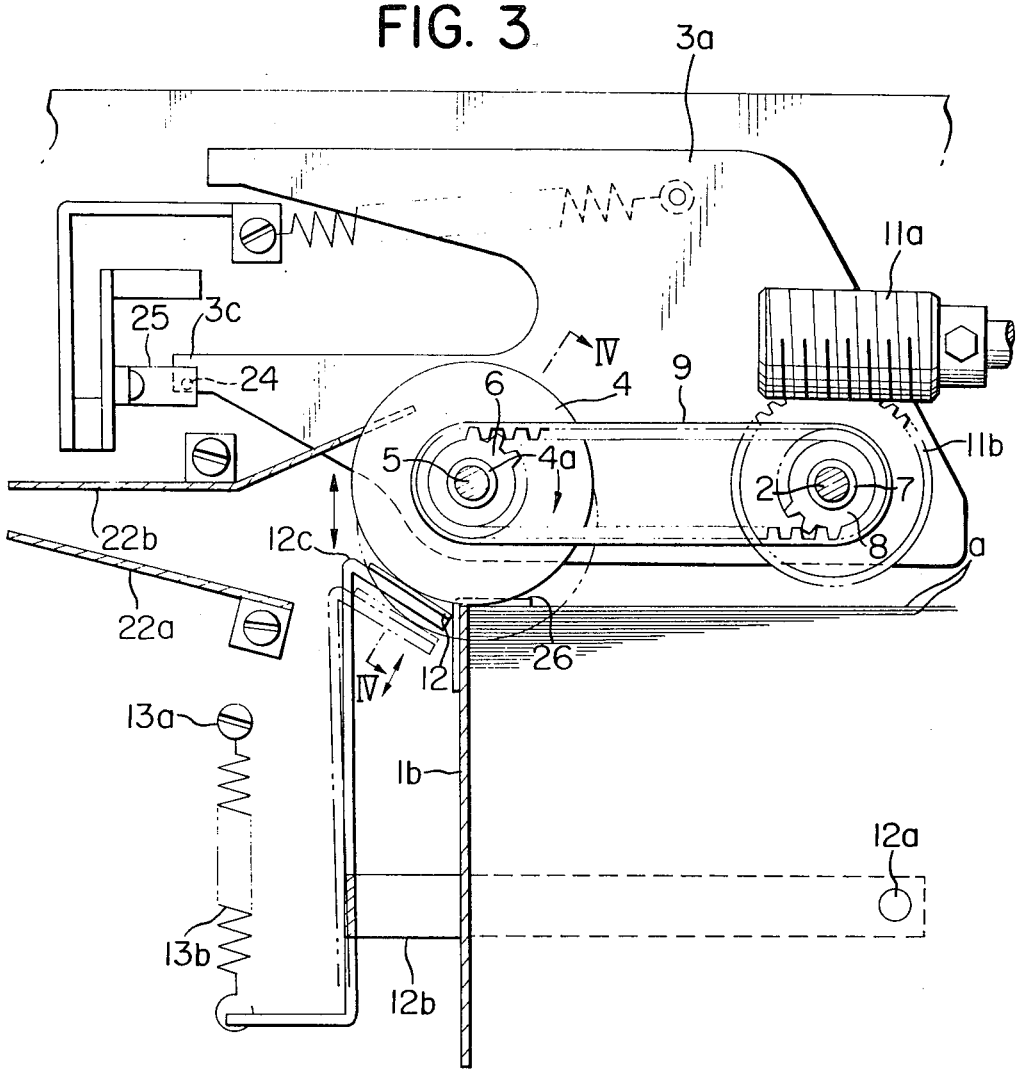
FIG. 3 is an enlarged side view showing a key portion of the device.

A partitioning wall 1*b* in the frame 1 located at the leading edge portion of the paper a loaded on the lift 14 is positioned near the place where the paper feeding roller 4 contacts the detachable plate 12 as shown in FIG. 2 and FIG. 3, and at each corner of said partitioning wall 1*b*, a separating claw 26 is provided for engaging both corners of the paper a fed out from said paper feeding roller 4, thereby separating the paper fed out from the paper not fed out. Therefore, the feeding out of the paper toward the registration roller 23 is further improved owing to the separating claws 26, the paper feeding roller 4 and the detachable plate 12.

Due to aforesaid arrangement of the present invention, the paper a on the lift 14 is fed out by the friction on the circumferential surface of the paper feeding roller 4 caused by the rotation of said paper feeding roller, and owing to the deterrent force caused by the friction of the detachable plate 12, papers are fed out one by one toward the registration roller 23, being separated perfectly to avoid multi-feed.

As papers are fed out, the position of the paper a on the lift 14 is lowered but the state of pressure contact between the circumferential surface of the paper feeding roller 4 and the paper a is kept on the feeding out level, because the paper feeding roller 4 is arranged horizontally on the reciprocable members 3*a* and 3*b* and the state of pressure contact between the detachable plate 12 and said paper feeding roller 4 is at such a level that the multi-feed of paper a can be prevented because the detachable plate 12 is raised by the spring 13*b*.

When the flapper 3*c* comes to a position where it does not break through the beam from the light-emitting element 24*a* opposite the position detector 24, due to the descent of the paper feeding roller 4 and the reciprocable members 3*a* and 3*b* caused by the feeding out of paper a, as described above, the lift 14 is raised and the ascent of the lift 14 causes the paper-feeding roller 4 and the flapper 3*c* to be moved upward; then the flapper 3*c* breaks through the beam of said light-emitting element 24*a*, whereupon the lift 13 is stopped. In other words, the position detector 24 is actuated by the flapper 3*c* and therefore the ascent of the lift 4 can be made smoothly by causing the flapper 3*c* to have the proper vertical movement, and the lift 14 is raised according to the sensing position of the position detector 24 and therefore the proper paper feeding position of papers on the lift 14 can always be kept relative to the guide plates 22*a* and 22*b*.

In conclusion, with the present invention, the desirable paper feeding condition wherein papers can always be fed out one by one may be maintained because the paper feeding roller is rotatably supported and the position detector is activated by the swiveling member, papers can be stacked on the lift, and therefore it is possible to securely load papers of 1000 sheets or more that weigh heavily.

What is claimed is:

1. In a paper feeding device of the type used for feeding stacked paper to an electrophotographic copying machine, a frame including a pair of vertically extending spaced side members, a subframe comprising a pair of interconnected end plates, a shaft extending between said side members and swingably supporting the end plates of said subframe for vertical reciprocal motion relative to said frame, a paper feeding roller, a second shaft extending between said end plates supporting said paper feeding roller, a platform holding a stack of paper, lift means for raising and lowering said platform and in its raised position urging the top paper of said stack into contact with said paper feeding roller, a movable plate having a seating surface, means urging said plate so that said seating surface contacts said paper feeding roller forward of its contact with said paper in the direction of travel of the latter, whereby said paper is fed forwardly by said roller into the nip between said roller and said seating surface, means on said frame detecting the vertical position of said swingable subframe and the feeding roller supported thereby, and means controlling the movement of said lift means for raising said platform and the stacked papers thereon in accordance with an output signal from said detecting means whenever a decrease in the height of the stacked papers results in a lowering of said subframe and the feeding roller carried thereby.

2. In a paper feeding device according to claim 1, the combination of separating claws mounted on said frame engaging the leading corners of the paper as fed out from the paper feeding roller.

3. In a paper feeding device according to claim 2, the combination of frictional material on said seating surface, and in which the means urging said plate comprises an arm extending therefrom, and a spring attached at one end to said arm and at its other end to said frame.

4. In a paper feeding device according to claim 3, in combination with a hollow cylindrical shaft mounted on and attached to said second shaft, and in which said paper feeding roller is formed as a disc integral with said cylindrical shaft.

* * * * *